US006490951B1

(12) United States Patent
Davidson

(10) Patent No.: US 6,490,951 B1
(45) Date of Patent: Dec. 10, 2002

(54) JAR OPENING AID

(76) Inventor: Charlton Davidson, 841 Cowan Rd., Dickson, TN (US) 37055

( * ) Notice: Subject to any disclaimer, the term of this patent is extended or adjusted under 35 U.S.C. 154(b) by 0 days.

(21) Appl. No.: 09/866,845

(22) Filed: May 30, 2001

(51) Int. Cl.[7] ..... B67B 7/18

(52) U.S. Cl. ..... 81/3.43; 81/3.09; 81/3.31; 81/64; 81/3.39

(58) Field of Search ..... 81/3.09, 3.31, 81/3.43, 3.39, 64; 7/110, 156

(56) References Cited

U.S. PATENT DOCUMENTS

| | | | | | |
|---|---|---|---|---|---|
| 152,940 | A | | 7/1874 | Bean | |
| 409,148 | A | | 8/1889 | Haller | |
| 562,418 | A | * | 6/1896 | Ragatz | 81/64 |
| 664,352 | A | | 12/1900 | Gibbs | |
| 671,319 | A | | 4/1901 | Gower | |
| 681,283 | A | | 8/1901 | Waynick | |
| 723,980 | A | | 3/1903 | Bogart | |
| 733,298 | A | | 7/1903 | Stull | |
| 1,266,510 | A | * | 5/1918 | McMeekin | 81/3.43 |
| 1,726,862 | A | * | 9/1929 | Schustarich | 81/3.43 |
| 2,132,207 | A | | 10/1938 | Donovan | |
| 2,162,445 | A | * | 6/1939 | Richel | 81/3.31 |
| 2,186,430 | A | * | 1/1940 | Richter | 81/3.43 |
| 2,317,037 | A | * | 4/1943 | Donovan | 81/3.43 |
| 2,481,055 | A | * | 9/1949 | Whitaker | 81/3.43 |
| 4,145,938 | A | | 3/1979 | Laird, Jr. | |
| 4,345,494 | A | | 8/1982 | Aamodt | |
| D268,164 | S | | 3/1983 | Sandberg | |
| 5,390,570 | A | | 2/1995 | Reisner | |
| D358,745 | S | | 5/1995 | Collier et al. | |
| 5,522,284 | A | | 6/1996 | Sade | |
| 5,704,258 | A | * | 1/1998 | LaVoie | 81/3.43 |
| 5,887,305 | A | * | 3/1999 | Cellini | 81/3.09 |
| 6,158,306 | A | * | 12/2000 | Gasparre | 81/3.43 |

FOREIGN PATENT DOCUMENTS

| | | |
|---|---|---|
| GB | 2161408 A | 1/1986 |

* cited by examiner

*Primary Examiner*—James G. Smith
(74) *Attorney, Agent, or Firm*—Richard C. Litman

(57) ABSTRACT

The instant invention includes a pair of strap devices which are utilized in combination to enable a person (especially the elderly and/or physically challenged) to open jars or similar containers with ease and simplicity. One of the strap devices is employed as a jar or container holder. The other device is used as a strap-type wrench. The holder is designed to be permanently mounted on a vertical surface. The wrench device can be utilized to remove vacuumed sealed, screw-on, crimped or pull-tab lids with relative ease.

16 Claims, 3 Drawing Sheets

JAR OPENING AID

BACKGROUND OF THE INVENTION

1. Field of the Invention

The present invention generally relates to kitchen utensils. More specifically, the present invention is drawn to a system for disengaging lids from containers, which lids may be vacuumed sealed and/or frictionally attached to the container via screw threads or the like.

2. Description of the Related Art

To avoid contamination and prevent tampering, most food, beverage, and medicine containers available in the marketplace are equipped with positively engaged lids (vacuumed sealed, screw or crimped). The lids are usually covered with a removable paper or plastic seal. Once the paper/plastic seal is removed, the lid still must be disengaged from the container. In this era of mass production, mechanized means are usually employed to engage the lids to the containers. The forces utilized to effect this engagement are often relatively large and require a disengagement force that is difficult to generate by normal human hand and wrist action. Even a hardy person must sometimes resort to extraordinary effort to remove a screwed-on-too-tight lid from a jar of juice. The difficulty is exacerbated for the elderly and/or physically challenged. An efficient, easy-to-use, inexpensive system to alleviate this situation would surely be a welcome addition to the art.

There are a number of devices for assisting a user to remove lids from containers. For example, U.S. Pat. Nos. Des. 268,164 (Sanberg) and Des. Pat. No. 358,745 (Collier et al.) Show designs for devices utilized to open jar lids. The Collier et al device incorporates a corkscrew. Neither patent incorporates a seal breaker, crimped cap remover or container holding device.

U.S. Pat. No. 152,940 (Bean), U.S. Pat. No. 409,148 (Haller), U.S. Pat. No. 664,352 (Gibbs) and U.S. Pat. No. 723,980 (Bogart) disclose apparatus for holding fruit jars to be filled. The holding apparatus is relatively complex and the patentees make no provision for removing the lid from the containers.

U.S. Pat. No. 671,283 (Gower) discloses a system for holding a container while affixing a lid thereto. The system of the instant patent is relatively complex and inefficient.

U.S. Pat. No. 681,283 (Waynick), U.S. Pat. No. 733,298 (Stull), U.S. Pat. No. 2,132,207 (Donovan) and U.S. Pat. No. 5,522,284 (Sade) show tools for removing or attaching screw type lids to fruit jars. The patentees make no provision for removing vacuum sealed and crimped lids, nor do they contemplate a device for holding the fruit jar.

U.S. Pat. No. 4,145,938 (Laird, Jr.), U.S. Pat. No. 4,345,494 (Aamodt) and U.S. Pat. No. 5,390,570 (Reisner) disclose strap-type wrenches for removing fuel and/or oil filters.

None of the above inventions and patents, taken either singularly or in combination, is seen to disclose a jar opening and holding system as will be subsequently described and claimed in the instant invention.

SUMMARY OF THE INVENTION

The instant invention includes a pair of strap devices which are utilized in combination to enable a person (especially the elderly and/or physically challenged) to open jars or similar containers with ease and simplicity. One of the strap devices is employed as a jar or container holder.

The other device is used as a strap-type wrench. The holder is designed to be permanently mounted on a vertical surface. The inside wall of a drawer or a splash board wall are ideally suited for mounting the holder. The strap-type wrench device may be conveniently stored with other small utensils or hung from a wall.

The holder device comprises a mounting bracket, a rubber strap, and a stabilizer bar. One end of the rubber strap is securely attached to the mounting bracket. The other end of the strap is a free end.

The strap-type wrench device comprises a hollow handle member and a rubber strap. One end of the rubber strap is secured to the hollow handle member. The other end is a free end. The wrench device has additional structure that can be utilized to remove vacuumed sealed, crimped or pull tab lids with relative ease.

Accordingly, it is a principal object of the invention to provide a system for facilitating the removal of lids from containers.

It is another object of the invention to provide a system which is adapted to specifically remove vacuumed sealed, screw-on, crimped and pull tab lids form containers.

It is a further object of the invention to provide a system for removing lids from containers, which system may be readily employed by the elderly and/or physically challenged.

Still another object of the invention is to provide a system for the removal of lids from containers, which system is efficient and easy to use.

It is an object of the invention to provide improved elements and arrangements thereof for the purposes described which are inexpensive, dependable and fully effective in accomplishing their intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
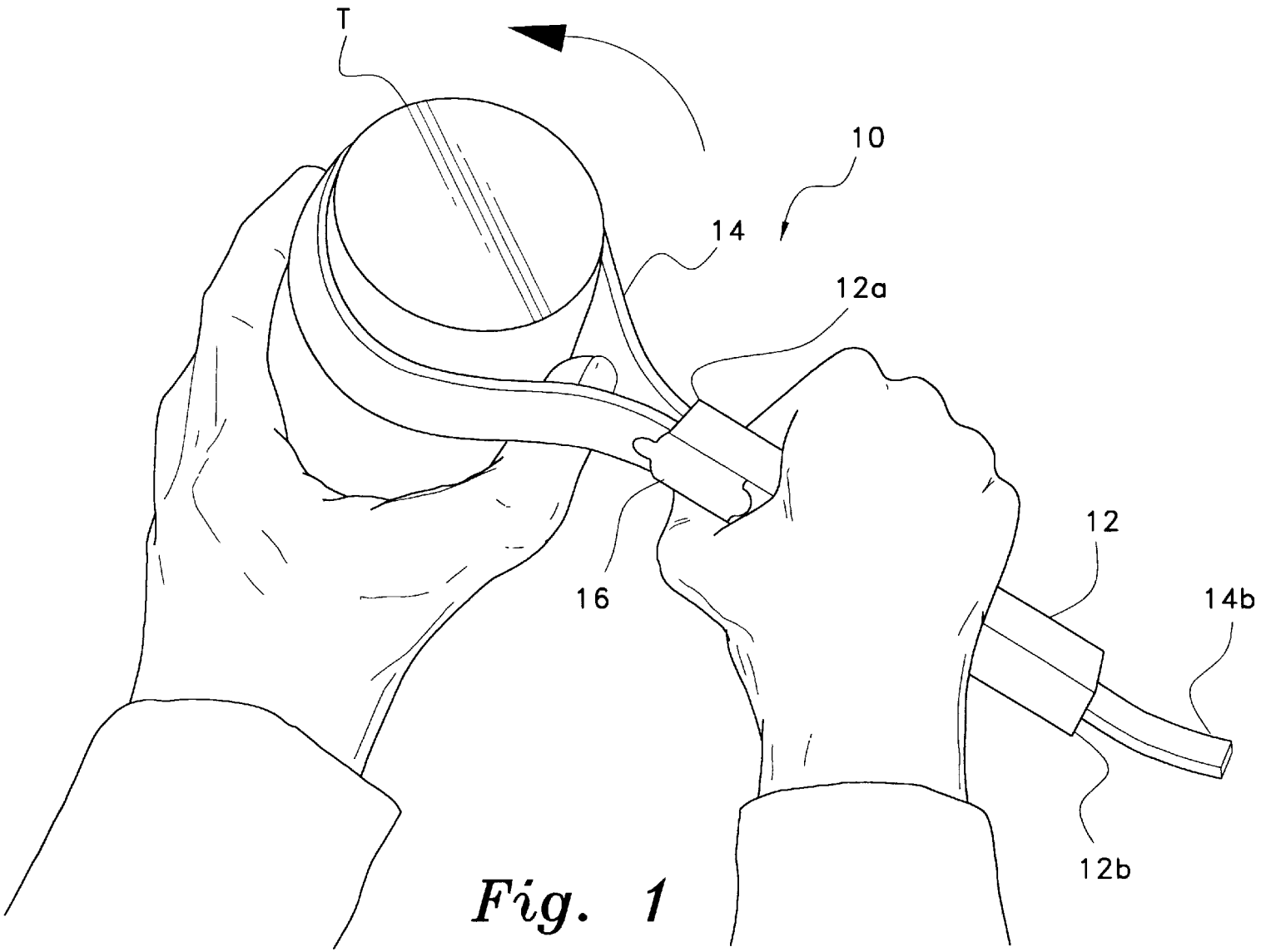
FIG. 1 is an environmental, perspective view of a container opening aid according to the present invention.
Figure 2:
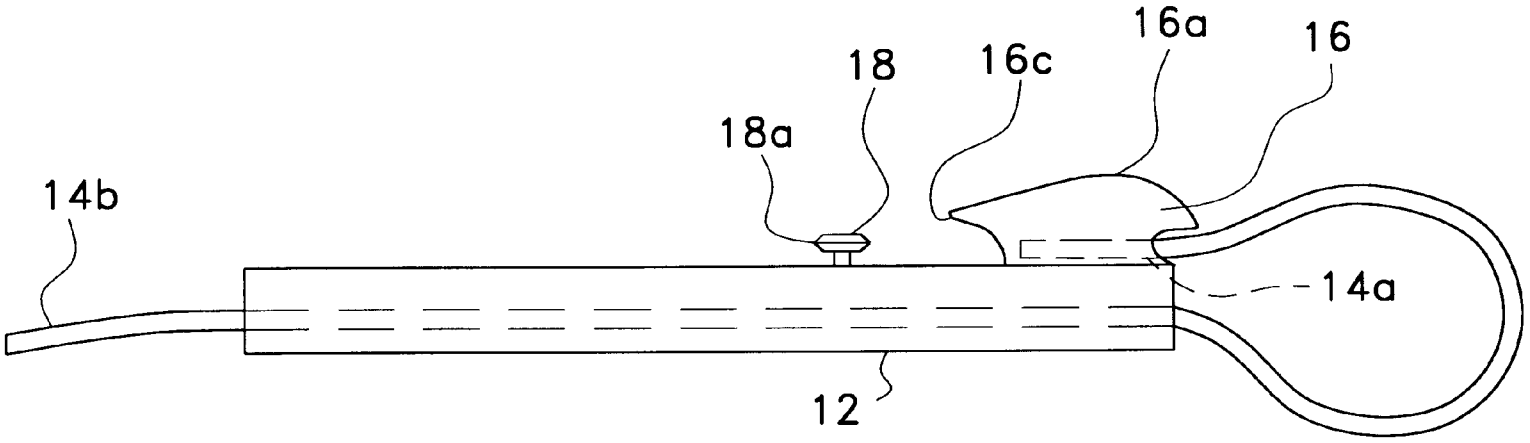
FIG. 2 is a side view of a container opening aid according to the present invention.
Figure 3:
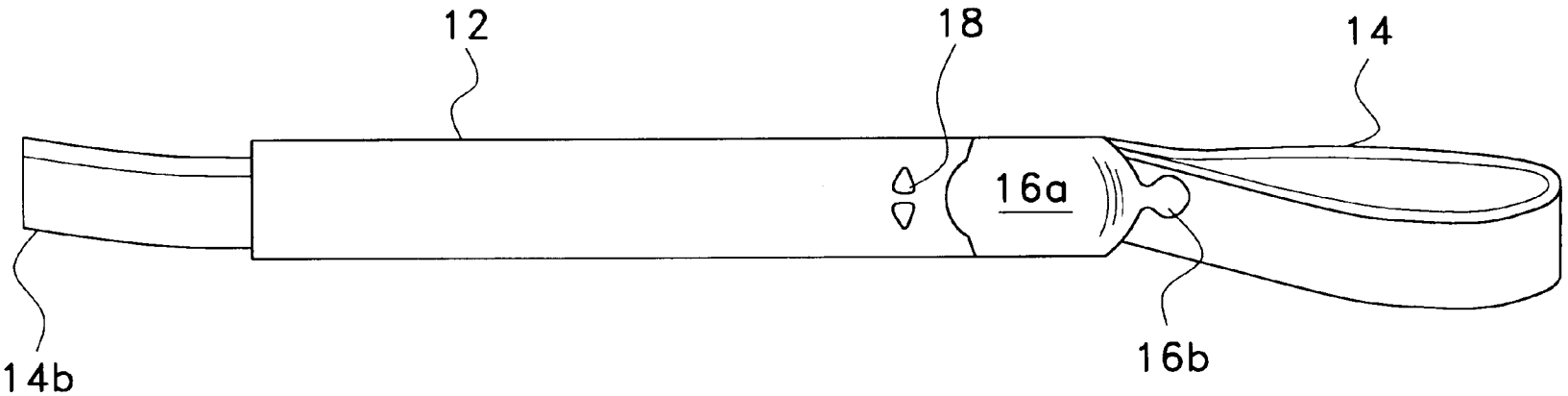
FIG. 3 is a top view of a container opening aid according to the present invention.

Attention is first directed to FIGS. 1–3 which illustrate the lid removal device of present system and is generally indicated at 10. Device 10 comprises a hollow, tubular member 12 having a front end 12*a* and a rear end 12*b*. An elongate, rubber strap 14 has one end 14*a* permanently attached at the front end 12*a* of tubular member 12. Strap 14 terminates in a free end 14*b*.

A multi-purpose opener 16 having an arcuate top surface 16*a* is disposed on the top surface of member 12 and securely attached thereto. Opener 16 has its forward end defined by a notched portion 16*b*. The rear end is defined as a lip portion 16*c*. Seal cutters 18 are positioned on member 12 adjacent lip portion 16*c*. Seal cutters 18 are provided with beveled edges 18*a*.

Using device 10 to disengage screwed-on lids is a very simple process. Free end 14*b* is inserted into tubular member 12 so that strap 12 is formed in a loop (FIG. 1). The loop is pulled to form a quasi-tight fit around the container top T. Tubular member 12 now functions as a handle supplying leverage to disengage the container top when member 12 is moved in a counter-clockwise direction as indicated by the arrow. It should be noted that movement of member 12 in the counter-clockwise direction would function to further tighten the loop around top T, thereby increasing efficiency and decreasing the amount of turning force that need be applied. Lip portion 16*c* functions as a conventional crimped-top bottle and/or vacuum seal opener when the handle is turned in an upside-down position. In the upside-down position, notch 16*b* is utilized to engage the tabs of pull-tab cans and the device may be rocked on arcuate surface 16*a* to facilitate removal of the pull-tabs. The sharp, beveled edges 18*a* of members 18 are employed to cut the security seals on containers. Edges 18*a* may further be employed to elevate an area to allow access for lip portion 16*c* in a vacuum release operation. It is clearly evident that device 10 can accomplish all but the most esoteric lid opening functions.

Figure 4:
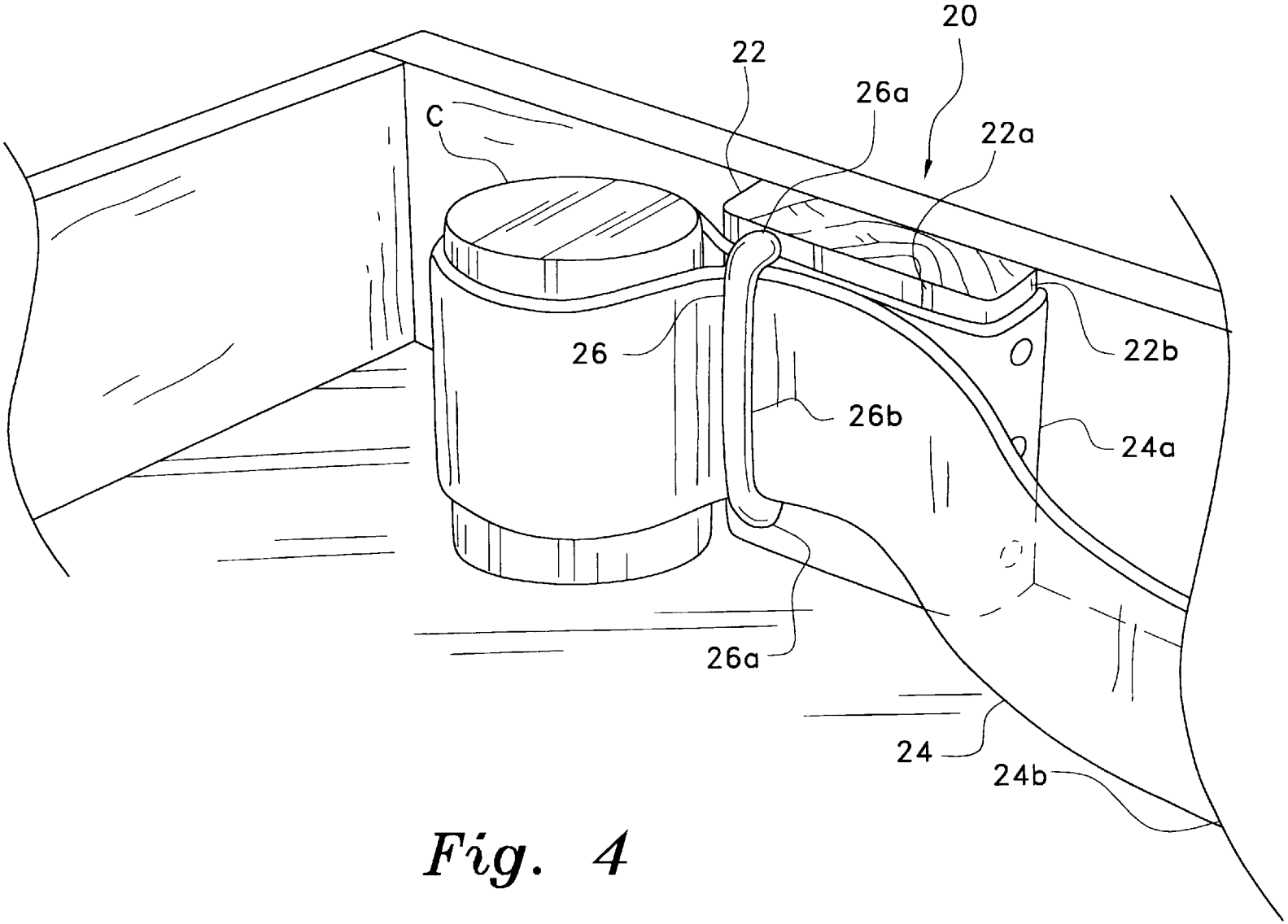
FIG. 4 is an environmental, perspective view of a container holder aid according to the present invention.

Attention is now directed to FIG. 4 which illustrates the container-holding device of the system and is generally indicated at 20. Device 20 comprises a base member 22 having a front face 22*a* and an end face 22*b*. An elongate strap 24 has one end 24*a* securely attached to end face 22*b*. Strap 24 terminates in a free end 24*b*. A stabilizer bracket 26 is provided with spaced-apart legs 26*a*, which legs are attached to base member 22 in any convenient and efficient manner. A portion 26*b* of the bracket spans the leg members and are integral therewith. Portion 26*b* is spaced from and parallel to front face 22*a*. Base member 22 is adapted to be secured to a vertical surface. As illustrated, base member 22 is secured to the inside vertical surface of a cabinet drawer, it is obvious however, that any convenient vertical surface would function as a suitable support.

Using device 20 merely requires that strap 24 is looped around container C and threaded through bracket 26 in a quasi-tight manner. Rotating container C in a direction toward the bracket will cause the strap to further tighten around the container to make for a secure hold. Device 10 can now be utilized to disengage the lid on the container. In employing this system, there is never a need for a user to grip the container thus, allowing for easy use by elderly and/or physically challenged persons.

Although plastic is preferred, tubular member 12, multi-purpose opener 16 and base member 22 may be fabricated from wood or metal if desired.

It is to be understood that the present invention is not limited to the embodiments described above, but encompasses any and all embodiments within the scope of the following claims.

I claim:

1. A system for removing lids from containers, said system comprising:

a base member, said base member having a front face and a side face;

a first elongate rubber strap for securely holding a container, said strap having a proximate end and a distal end, said proximate end being attached to said side face of said base member, said distal end being a free end;

a stabilizer bracket, said stabilizer bracket having a pair of spaced-apart leg members, said leg members attached to said front face of said base member, wherein said stabilizer bracket includes a portion spanning and integral with said leg members, said portion being spaced from and parallel to said front face of said base member;

a hollow tubular member, said tubular member having a front end and a rear end; and means fixed to said hollow tubular member at said front end for removing a lid from the container.

2. A system for removing lids as recited in claim 1, wherein said means includes a second elongate rubber strap having a first end and a second end, said first end attached to said front end of said tubular member, said second end being a free end.

3. A system for removing lids as recited in claim 2, wherein said means further includes;

a multi-purpose opener, said multi-purpose opener having an arcuate upper surface, a forward end and a rearward end, said multi-purpose opener being attached to said front end of said tubular member.

4. A system for removing lids as recited in claim 3, including a notched portion, said notched portion defining said forward end of said multi-purpose opener.

5. A system for removing lids as recited in claim 4, including a lip portion, said lip portion defining said rearward end of said multi-purpose opener.

6. A system for removing lids as recited in claim 5, wherein said means further includes;

at least one seal cutter, said seal cutter being attached to said tubular member adjacent said lip portion of said multi-purpose opener.

7. A system for removing lids as recited in claim 6, including at least one beveled edge formed on said seal cutter.

8. A system for removing lids as recited in claim 7, wherein said base member is fabricated from materials selected from the group consisting of plastic, wood and metal.

9. A system for removing lids as recited in claim 8, wherein said tubular member is fabricated from materials selected from the group consisting of plastic, wood and metal.

10. A device for holding containers comprising:

a base member, said base member having a front face and a side face;

an elongate rubber strap, said strap having a proximate end and a distal end, said proximate end attached to said side face, said distal end being a free end;

a stabilizer bracket, said stabilizer bracket having a pair of spaced-apart leg members, said leg members attached to said front face of said base member;

a portion of said stabilizer bracket spanning and integral with said leg members, said portion being spaced from and parallel to said front face of said base member.

11. A device for holding containers as recited in claim 10, wherein said base member is fabricated from materials selected from the group consisting of plastic, wood and metal.

12. A device for removing lids from containers, said device comprising:

a hollow tubular member, said tubular member having a front end and a rear end;

an elongate rubber strap having a first end and a second end, said first end attached to said front end of said tubular member, said second end being a free end; and a multi-purpose opener, said multi-purpose opener having an arcuate upper surface, a forward end and a rearward end, said multi-purpose opener being attached to said front end of said tubular member. multi-purpose opener being attached to said front end of said tubular member.

13. A device for removing lids as recited in claim 12, including;

a notched portion, said notched portion defining said forward end of said multi-purpose opener; and a lip portion, said lip portion defining said rearward end of said multi-purpose opener.

14. A device for removing lids as recited in claim 13, wherein including;

a seal cutter, said seal cutter being attached to said tubular member adjacent said lip portion of said multi-purpose opener.

15. A device for removing lids as recited in claim 14, including at least one beveled edge formed on said seal cutter.

16. A device removing lids as recited in claim 15, wherein said tubular member is fabricated from materials selected from the group consisting of plastic, wood and metal.

* * * * *